US007198383B2

(12) United States Patent
Martino

(10) Patent No.: US 7,198,383 B2
(45) Date of Patent: Apr. 3, 2007

(54) LIGHT EMITTING ART PORTRAYAL

(76) Inventor: Marc Gregory Martino, 5636 Vercelly Ct., Westlake Village, CA (US) 91362

( * ) Notice: Subject to any disclaimer, the term of this patent is extended or adjusted under 35 U.S.C. 154(b) by 0 days.

(21) Appl. No.: 10/893,202

(22) Filed: Jul. 17, 2004

(65) Prior Publication Data

US 2006/0012994 A1 Jan. 19, 2006

(51) Int. Cl.
*F21V 21/00* (2006.01)

(52) U.S. Cl. ..... 362/249; 362/123; 362/800

(58) Field of Classification Search ..... 362/249–250, 362/123, 806, 320, 252; 40/124.02, 431, 40/443, 502, 550, 616
See application file for complete search history.

(56) References Cited

U.S. PATENT DOCUMENTS 5,477,437 A * 12/1995 Lach ..... 362/252
5,575,098 A * 11/1996 Goettel-Schwartz ..... 40/550
6,341,875 B1 * 1/2002 Chu ..... 362/252
6,402,336 B1 * 6/2002 Reese ..... 362/103
6,641,283 B1 * 11/2003 Bohler ..... 362/238
6,783,259 B1 * 8/2004 Macedonio ..... 362/251

OTHER PUBLICATIONS

Domestications Magazine ,Holiday 2003, P.O, Box 1568 La Crosse ,WI 54602-1568, p. 53 (Lighted Tree Lace Window Panel).

* cited by examiner

*Primary Examiner*—Ali Alavi

(57) ABSTRACT

A light emitting art portrayal is disclosed. An exemplary embodiment includes a generally flat substrate having a front side, a back side, a top edge, a bottom edge, a right edge, and a left edge. The substrate has a height defined by the distance between the top edge and the bottom edge. The substrate has a width defined by the distance between the right edge and the left edge. The substrate has a thickness defined by the distance between the front side and back side. An image is portrayed on the front side and is visible from the front side. The image resembles at least one Christmas tree. At least one light emitting source is affixed to the substrate. The light emitting source is visible from the front side. The light emitting source is portrayed as a Christmas tree light.

20 Claims, 8 Drawing Sheets

LIGHT EMITTING ART PORTRAYAL

BACKGROUND OF THE INVENTION

1. Field of the Invention

The present invention relates in general to art portrayals, and in particular to art portrayals with an image of a Christmas tree having a light emitting source affixed to the art portrayal.

2. Description of Related Art

The tradition of the Christmas tree is well established in many societies across the globe. During the holiday season, it is a tradition to construct some variation of a Christmas tree in one's home. Yet it is not always a simple task to construct a Christmas tree for numerous reasons.

Many families opt to purchase or cut down a real tree for their home. The process of getting a real tree is a physically demanding task. One must either travel to the wilderness to cut down a tree, or travel to a tree broker and purchase a tree. In either case the tree must be put in one's vehicle and transported home. This physically demanding task is usually done by the most physically active member of the family, typically the head of the household. Yet, many people cannot transport such a large and heavy object. Once a real Christmas tree is retrieved, it is another task to set it up. This feat requires not only physical stamina, but experience to properly level and secure the tree with minimal readjustment.

A real Christmas tree must also be disposed of after the holidays. Disposing of a brittle Christmas tree can be more hassle than setting it up. A dead tree must be disposed of quickly, because it can easily be a major fire hazard in one's home. The needles become brittle and the tree can easily catch fire and burn, particularly because most trees have electrically powered lights hung on them. Major cleaning must be done where the tree once stood. Furthermore, many trash companies do not take a whole tree. The tree must be sawed into smaller pieces and fit within the standard size trash receptacle before many trash companies will dispose of it.

To avoid the hassle of securing a real Christmas tree, many families opt for purchasing an artificial Christmas tree. Such a tree can be stored during the summer season, and reassembled during the holidays. An artificial Christmas tree is usually less expensive when factoring the cost savings over numerous years of use, but even an artificial tree can be expensive. An artificial tree is not hassle free either as it also takes time and effort to assemble. Each branch must be secured within an artificial tree trunk. This process can take hours to assemble a moderately sized tree. Also, artificial trees must be stored, which imposes upon the limited amount of storage space owned by most people.

In either case, real or artificial, Christmas trees take time to decorate. In many families, it is a family chore to decorate and prepare the tree. Lights and decorations can take a whole day to be placed upon a tree. After the holidays, all the lights and decorations must be taken down and stored until the next holiday. Storing the decorations also takes up space in one's home.

Both artificial and real Christmas trees take up space. In today's crowded world, many households do not have the room to setup a full-sized Christmas tree. Many households, lack the room to setup even a miniature Christmas tree. Even a miniature Christmas tree takes up some floor space. For some households who have very limited space, they can put up a flat cloth tree in lieu of a real tree. The cloth tree can be hung over a mantle or against a door taking up very little space. However, this cloth tree is a poor substitute for a real tree due to its substandard appearance. Cloth trees are made from thick yarn and tend to look cheap and childish. Furthermore, cloth trees are not strung with Christmas tree lights, the hallmark of a Christmas tree. Due to all of the above mentioned shortcomings, many households do not put up a tree at all. For example dormitory rooms, military barracks, hospital rooms, senior citizen homes, small apartments and offices rarely have any form of a Christmas tree due to the space restrictions and inconvenience considerations.

There are posters manufactured today that contain some variation of a holiday related scene. These posters are similar to any common poster that one would place in the home or office as wall art. The posters are manufactured by printing an image on top of a paper substrate. These posters do not function as a replacement for a Christmas tree for many reasons. The size of the poster is usually smaller than that of a Christmas tree. The poster's image does not realistically or stylistically resemble a Christmas tree. Moreover, the poster does not contain any Christmas tree lights.

It can be seen, then, that there is a need for a Christmas tree substitute that can be cheaply purchased, compactly stored, and easily set up. It can be seen that this Christmas tree substitute is to be used in locations where space is at a premium. There is also a need for this Christmas tree substitute to have some form of light emitting source so it creates a light effect similar to a decorated Christmas tree. It can also be seen that there is a need for this Christmas tree substitute to be thin and capable of being placed along walls and doors to avoid taking up floor space.

SUMMARY OF THE INVENTION

To minimize the limitations of related art, and to minimize other limitations that will become apparent upon reading and understanding the present specification, the present invention discloses a light emitting art portrayal. An exemplary embodiment of the light emitting art portrayal includes a generally flat substrate having a front side and a back side. The front side faces opposite the back side. The substrate has a top edge and a bottom edge. The top edge is opposite the bottom edge. The substrate has a height defined by the distance between the top edge and the bottom edge. The substrate has a right edge and a left edge. The right edge is opposite the left edge. The substrate has a width defined by the distance between the right edge and the left edge. The substrate has a thickness defined by the distance between the front side and back side. An image is portrayed on the front side and is visible from the front side. The image resembles at least one Christmas tree. At least one light emitting source is affixed to the substrate. The light emitting source is visible from the front side. The light emitting source is portrayed as a Christmas tree light.

In an exemplary embodiment the height is greater than 11 inches, the width is greater than 8.5 inches, and the thickness is less than 1 inch. Another exemplary embodiment includes an electrical input affixed to the substrate where the electrical input is electrically coupled to at least one light emitting source. In another exemplary embodiment the substrate is flexible. In another exemplary embodiment the substrate is rigid. In another exemplary embodiment the substrate is comprised of at least two rigid sections connected by a flexible joint. In another exemplary embodiment a battery is affixed to the substrate and electrically coupled to the electrical input. In another exemplary embodiment an electrical plug is affixed to the substrate and electrically coupled to the electrical input.

It is an object of the light emitting art portrayal to provide an art portrayal of an image of a Christmas tree that includes a light emitting source on the art portrayal. It is another object of the light emitting art portrayal to provide an art portrayal that can be used in lieu of a real or artificial Christmas tree. It is another object of light emitting art portrayal to be used in locations where space is at a minimum. The light emitting art portrayal can be utilized in locations where Christmas trees typically aren't used. It is another object of the light emitting art portrayal to be placed upon a substantially vertical surface so it may resemble a Christmas tree while taking up no floor space. It is another object of the light emitting art portrayal to be compactly stored requiring significantly less space than a real or artificial Christmas tree. It is another object of the light emitting art portrayal to be easily purchased, quickly displayed and compactly storable.

BRIEF DESCRIPTION OF THE DRAWINGS

Referring now to the drawings in which like reference numbers represent corresponding parts throughout.

DETAILED DESCRIPTION

In the following description of the exemplary embodiments, reference is made to the accompanying drawings that form a part hereof, and in which is shown by way of illustration embodiments in which the invention may be practiced. It is to be understood that other embodiments may be utilized and structural changes may be made without departing from the scope of the present invention.

Figure 1:
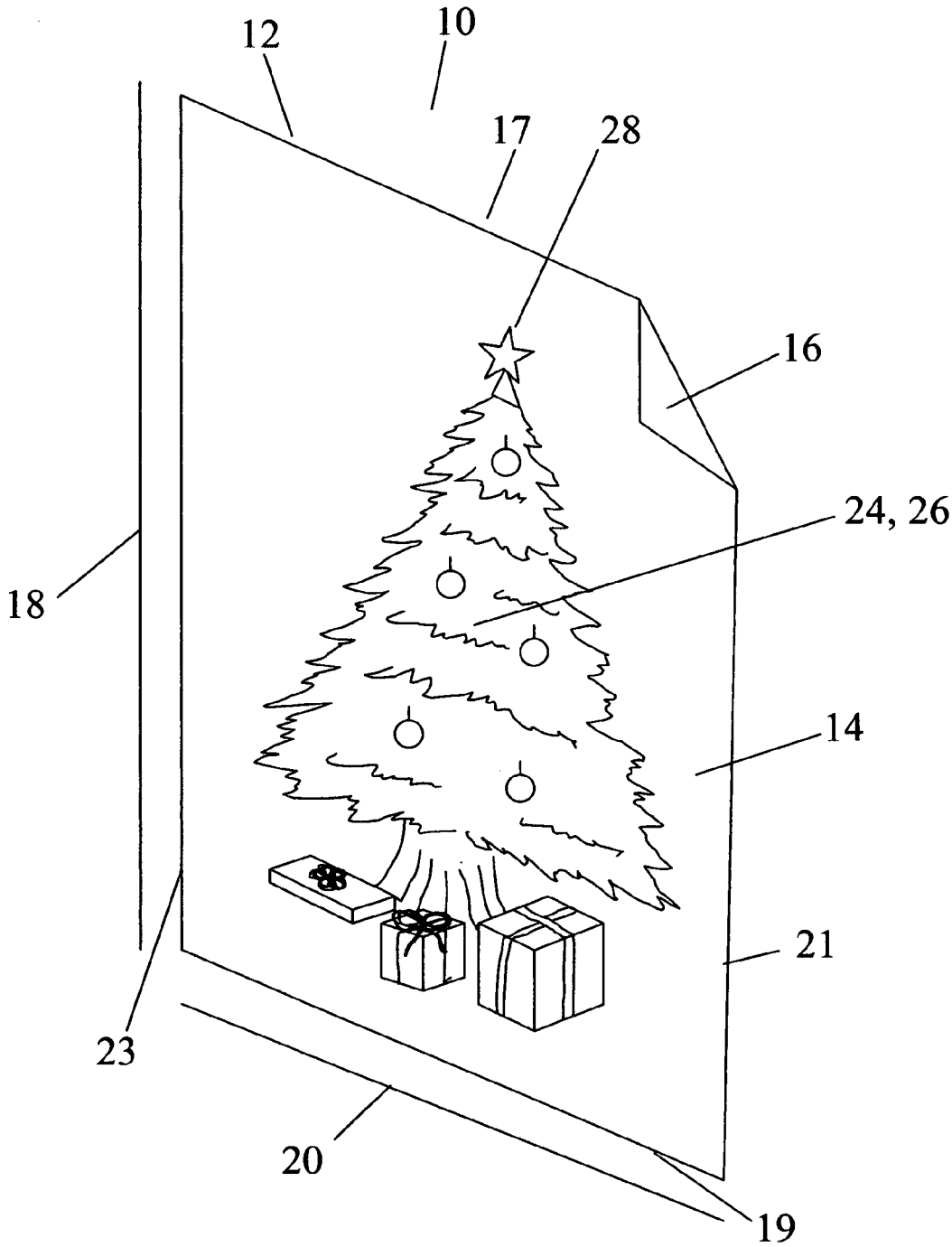
FIG. 1 illustrates an embodiment of a light emitting art portrayal in isometric view.

A light emitting art portrayal 10 is shown in FIG. 1 having a substrate 12, a front side 14, a back side 16, a top edge 17, a height 18, a bottom edge 19, a width 20, a right edge 21, and a left edge 23. Portrayed on the substrate 12 is an image 24. Image 24 portrays at least one Christmas tree 26. In this exemplary embodiment the image 24 depicts Christmas tree 26 with wrapped presents underneath. Affixed to substrate 12 is at least one light emitting source 28. Light emitting source 28 is shown as a star placed at the top of the Christmas tree 26.

Substrate 12 is shown as being made of paper, but can be made from a range of materials including plastic, cardboard, wood, metal, cloth, lace, synthetic fibers, real fibers or any other equivalent material that can have an image 24 portrayed thereon and a light emitting source 28 connected thereto. The substrate 12 may be made to be flexible so that it can be folded or rolled for compact storage. The substrate 12 may be entirely rigid or made from at least two rigid sections 32 connected by a flexible joint 34. The flexible joint 34 may be made by folding the substrate at a repeated location, such as the folds in a cardboard box. The substrate 12 may be rectangular in shape, square in shape, or any arbitrary shape that has an amount of surface area for the image 24 to be portrayed upon. The substrate 12 may even resemble the shape of a Christmas tree. The light emitting source 28 can be a light emitting diode, a standard light bulb, a Christmas light bulb, an illuminating film or any equivalent source that produces light. Moreover, the light emitting source can be a plurality of separate devices that can be interconnected. In an exemplary embodiment, the light emitting source is a light emitting diode that is flat and small in nature. This allows the substrate 12 to remain thin and be compactly stored, but also provides enough light to resemble a Christmas tree light or a star in the night sky.

Figure 2:
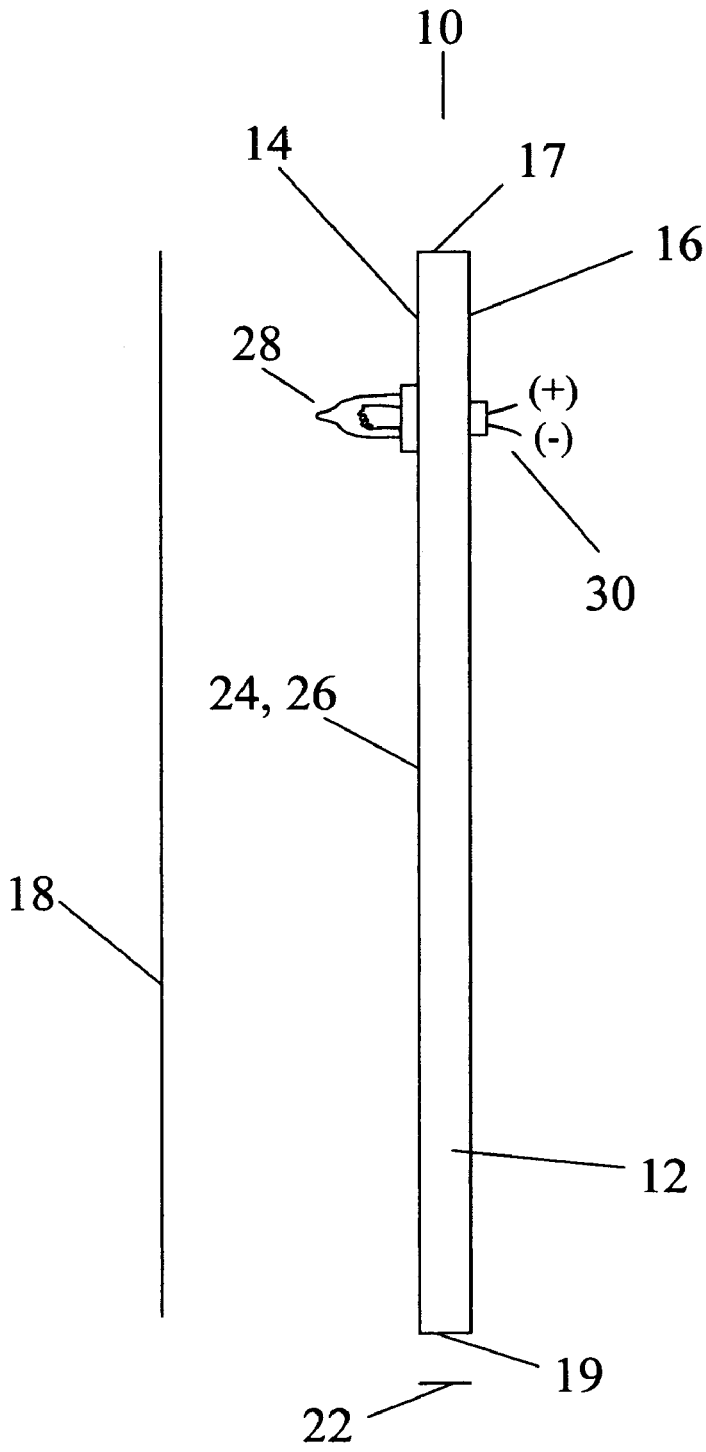
FIG. 2 illustrates the light emitting art portrayal of FIG. 1 in side view.

The light emitting art portrayal 10 is shown in FIG. 2 in side view having an electrical input 30 connected to the substrate 12. The electrical input 30 is electrically coupled to the light emitting source. Electrical input 30 allows positive and negative connections to be electrically coupled with the light emitting source 28 to provide electrical power. The electrical input 30 can be made in many different variations. The electrical input 30 can be placed at any desirable location on the substrate 12. The electrical input 30 may be extended with an electrical wire from the substrate 12 so that it may be connected up to a power source further away, such as an electrical wall outlet.

Figure 3:
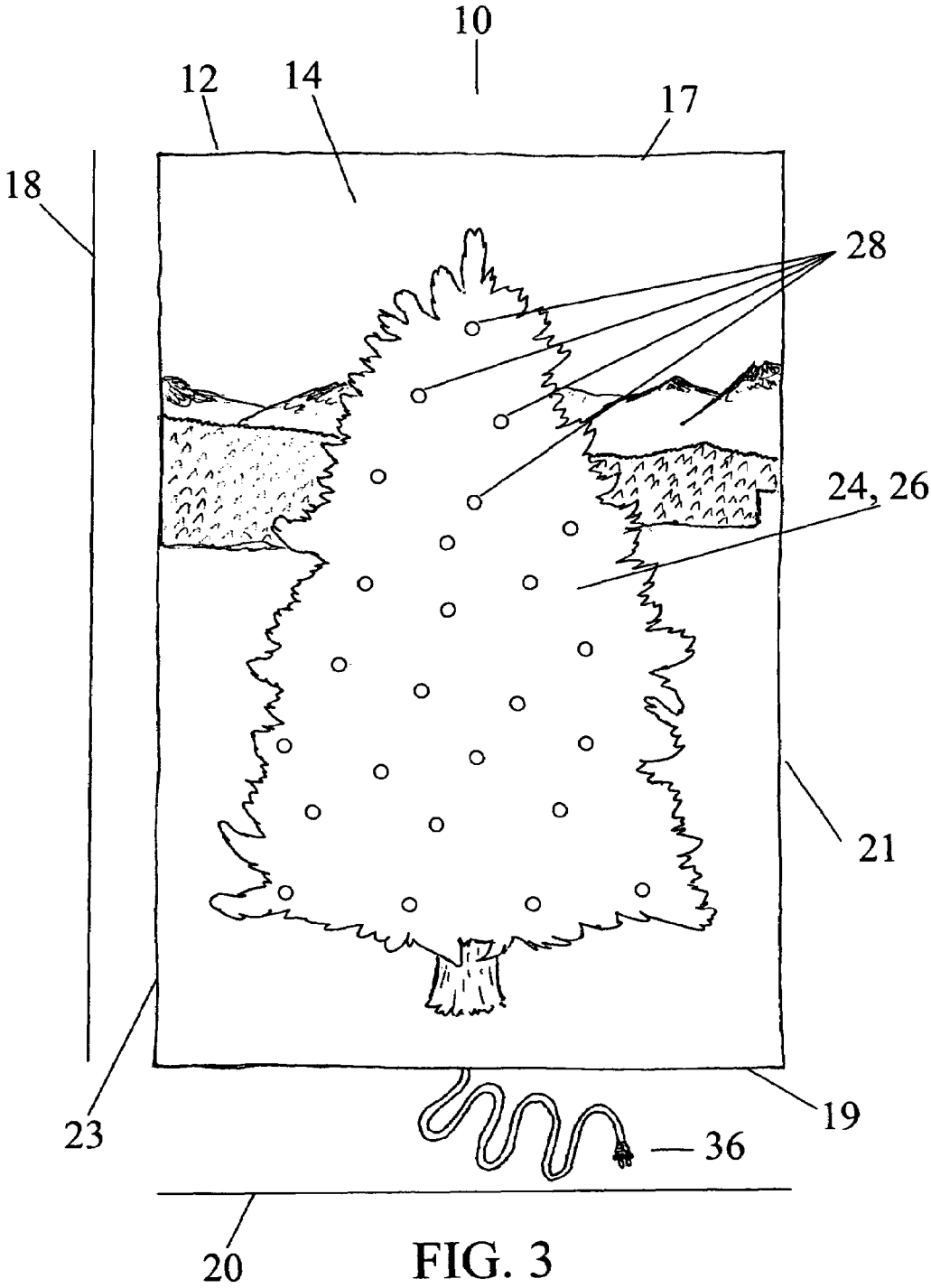
FIG. 3 illustrates another embodiment of a light emitting art portrayal in a front view.

The light emitting art portrayal 10 is shown in FIG. 3 in front view having an electrical plug 36. The electrical plug 36 is shown for connecting to a standard wall outlet. The electrical plug is electrically coupled to the electrical input 30 which is electrically coupled to each light emitting source 28. The electrical plug 36 could also include an electrical device that regulates the standard wall outlet electricity to a form that the light emitting source 28 requires. Any known means for electrically coupling, however, could be used.

Figure 4:
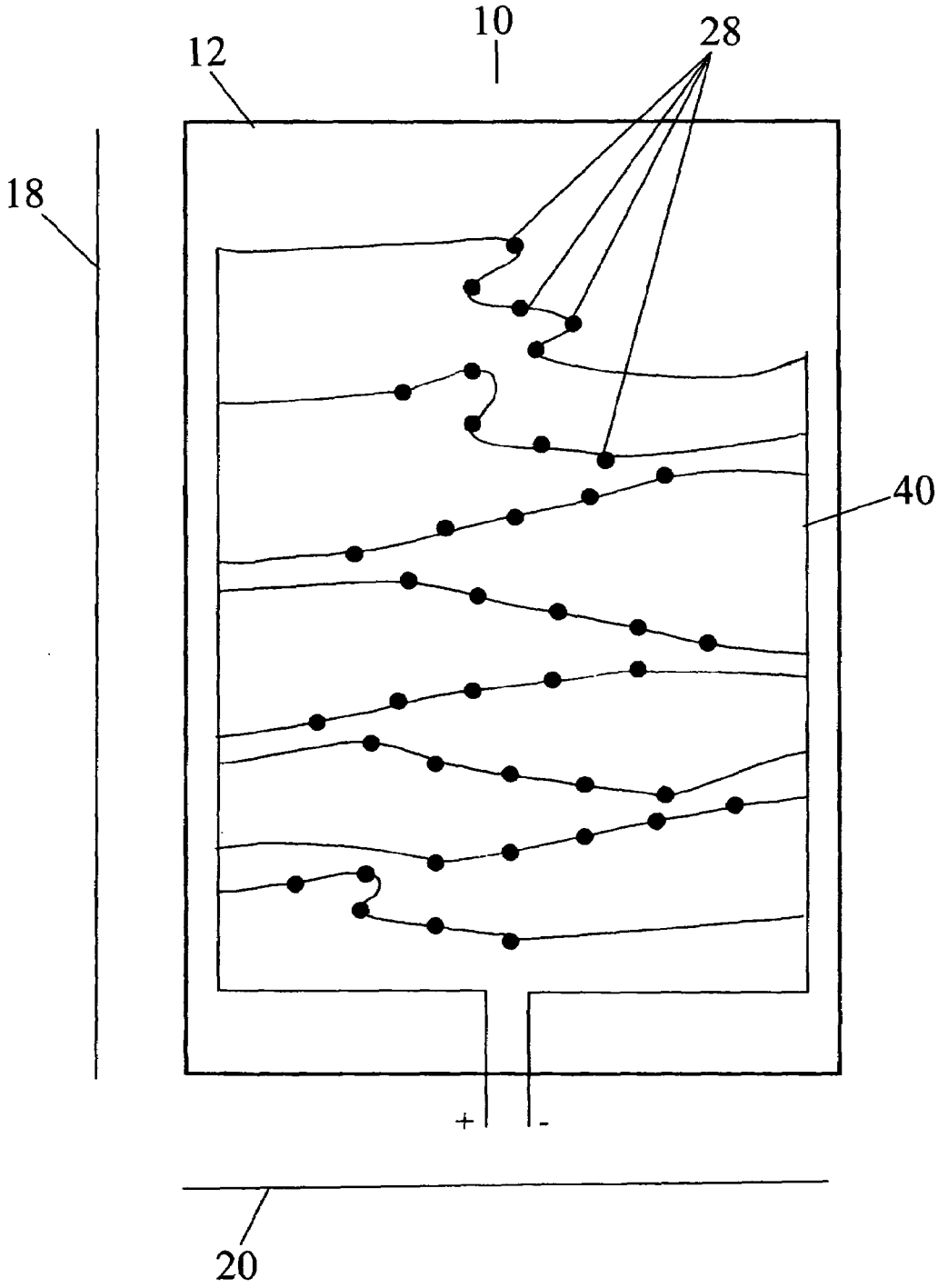
FIG. 4 illustrates another embodiment of a light emitting art portrayal in an electrical schematic front view.
Figure 5:
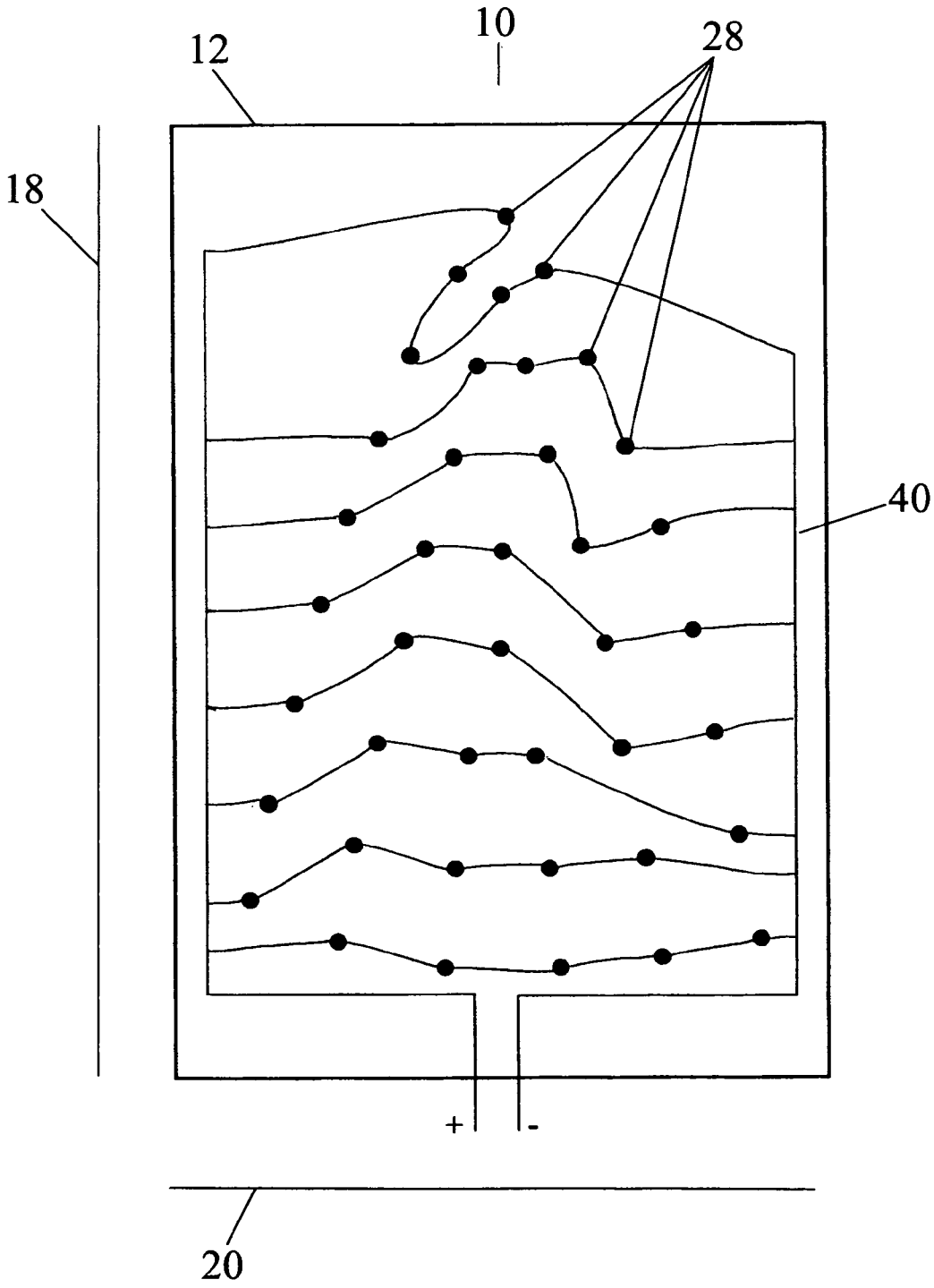
FIG. 5 illustrates another embodiment of the light emitting art portrayal in FIG. 4 in an electrical schematic front view.

The light emitting art portrayal 10 is shown in FIG. 4 in an electrical schematic front view. An exemplary wiring configuration can include a combination of parallel and/or series connections that provide electrical power to the light emitting source 28. These electrical connections may be made with an electrical path 40. Electrical path 40 may be made from a thin electrical wire attached to the substrate 12 or from a flat material that conducts electricity or from any other method of transferring electrical power to the light emitting source 28. Another exemplary electrical path 40 is shown in FIG. 5.

Figure 6:
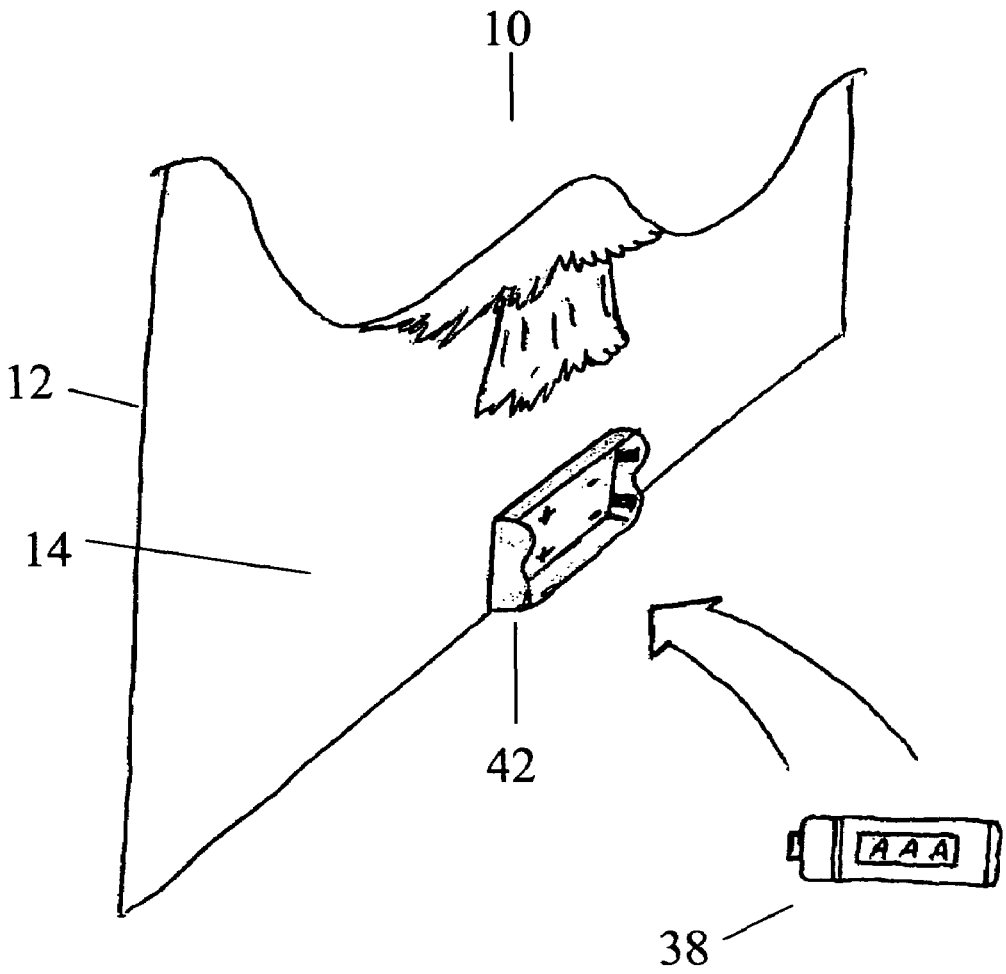
FIG. 6 illustrates another embodiment of the light emitting art portrayal in FIG. 3 in a cutaway isometric view.

The light emitting art portrayal 10 is shown in FIG. 6 in a cutaway isometric view where part of the substrate 12 is cutaway from view. Affixed on substrate 12 is a battery receiver 42 designed to secure a battery 38. The battery 38 electrically couples to the light emitting source as shown in other figures and represents one suitable means for powering the light emitting source.

Figure 7:
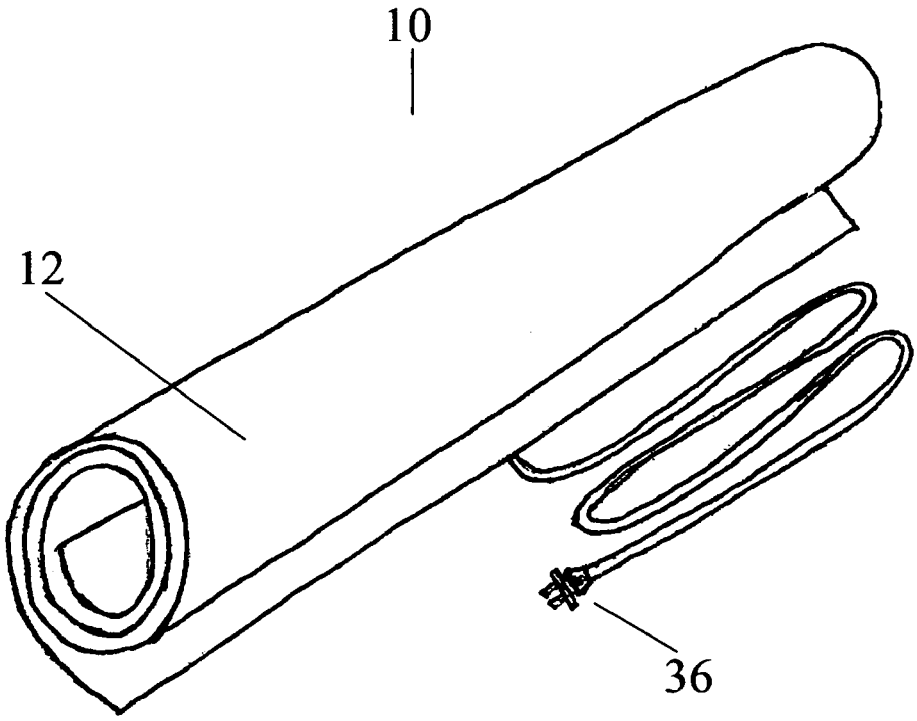
FIG. 7 illustrates another embodiment of the light emitting art portrayal in FIG. 3 in an isometric view.

The light emitting art portrayal 10 is shown in FIG. 7 in isometric having the electrical plug 36 as depicted in FIG. 3. Substrate 12 is shown being made from a flexible material so that it may be rolled or folded for compact storage.

Figure 8:
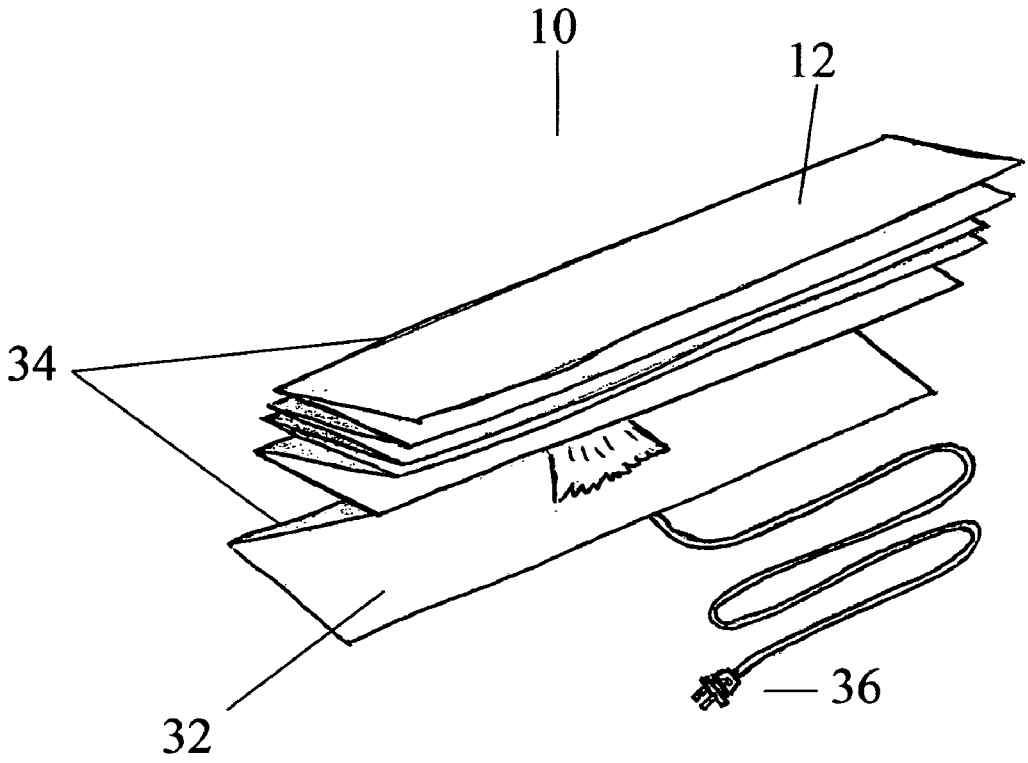
FIG. 8 illustrates another embodiment of the light emitting art portrayal in FIG. 3 in an isometric view.

The light emitting art portrayal 10 is shown in FIG. 8 with substrate 12 and electrical plug 36. In FIG. 8 the substrate 12 includes at least one rigid section 32 connected by a flexible joint 34 so that the substrate 12 can be folded for compact storage. Thus, various materials and configurations can be beneficially used to achieve a desired structure for mounting and storage, as well as shipment/transport of the product.

| Reference Number List | |
|---|---|
| Light Emitting Art Portrayal | 10 |
| Substrate | 12 |
| Front Side | 14 |
| Back Side | 16 |
| Top Edge | 17 |
| Height | 18 |
| Bottom Edge | 19 |
| Width | 20 |
| Right Edge | 21 |
| Thickness | 22 |
| Left Edge | 23 |
| Image | 24 |
| Christmas Tree | 26 |
| Light Emitting Source | 28 |
| Electrical Input | 30 |
| Rigid Section | 32 |
| Flexible Joint | 34 |
| Electrical Plug | 36 |
| Battery | 38 |
| Electrical Path | 40 |
| Battery Receiver | 42 |

Conclusion

In summary, a light emitting art portrayal was disclosed. An exemplary embodiment of the light emitting art portrayal includes a generally flat substrate having a front side and a back side. The front side faces opposite the back side. The substrate has a top edge and a bottom edge. The top edge is opposite the bottom edge. The substrate has a height defined by the distance between the top edge and the bottom edge. The substrate has a right edge and a left edge. The right edge is opposite the left edge. The substrate has a width defined by the distance between the right edge and the left edge. The substrate has a thickness defined by the distance between the front side and back side. An image is portrayed on the front side and is visible from the front side. The image resembles at least one Christmas tree. At least one light emitting source is affixed to the substrate. The light emitting source is visible from the front side. The light emitting source is portrayed as a Christmas tree light.

The foregoing description of exemplary embodiments has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A light emitting art portrayal comprising:

a generally flat poster substrate comprising a front side and a back side facing opposite the front side, a top edge and a bottom edge opposite the top edge, a height defined by the distance between the top edge and the bottom edge, a right edge and a left edge opposite the right edge, a width defined by the distance between the right edge and the left edge, and a thickness defined by the distance between the front side and back side;

an image portrayed on the front side and visible from the front side where the image substantially resembles at least one Christmas tree; and at least one light emitting source integrally and non-removably joined with the poster substrate where the light emitting source is visible from the front side, and wherein the light emitting source is a light emitting diode.

2. The light emitting art portrayal of claim 1, wherein at least one light emitting source is portrayed as a Christmas tree light.

3. The light emitting art portrayal of claim 2, wherein the height is greater than 11 inches and the width is greater than 8.5 inches.

4. The light emitting art portrayal of claim 3, wherein the thickness is less than 1 inch.

5. The light emitting art portrayal of claim 4, further including an electrical input affixed to the poster substrate where the electrical input is electrically coupled to at least one light emitting source.

6. The light emitting art portrayal in claim 5, wherein the poster substrate is flexible.

7. The light emitting art portrayal in claim 5, wherein the poster substrate is rigid.

8. The light emitting art portrayal in claim 5, wherein the poster substrate is comprised of at least two rigid sections connected by a flexible joint.

9. The light emitting art portrayal in claim 5, further including a battery affixed to the poster substrate and electrically coupled to the electrical input.

10. The light emitting art portrayal in claim 5, further including an electrical plug affixed to the poster substrate and electrically coupled to the electrical input.

11. A light emitting display comprising:

a generally flat poster substrate comprising a front side and a back side facing opposite the front side, a top edge and a bottom edge opposite the top edge, a height defined by the distance between the top edge and the bottom edge where the height is greater than 11 inches, a right edge and a left edge opposite the right edge, a width defined by the distance between the right edge and the left edge where the width is greater than 8.5 inches, and a thickness defined by the distance between the front side and back side where the thickness is less than 0.5 inches;

an image portrayed on the front side and visible from the front side where the image substantially resembles at least one Christmas tree;

at least one light emitting source integrally and non-removably joined with the poster substrate where the light emitting source is visible from the front side and the light emitting source is portrayed as a Christmas tree light, wherein the light emitting source is a light emitting diode; and at least one electrical input affixed to the poster substrate where the electrical input is electrically coupled to at least one light emitting source.

12. The light emitting display in claim 11, wherein the poster substrate is flexible.

13. The light emitting display in claim 11, wherein the poster substrate is rigid.

14. The light emitting display in claim 11, wherein the poster substrate is comprised of at least two rigid sections connected by a flexible joint.

15. The light emitting display in claim 11, further including a battery affixed to the poster substrate where the battery is electrically coupled to the electrical input.

16. The light emitting display in claim 11, further including an electrical plug affixed to the poster substrate where the electrical plug is electrically coupled to the electrical input.

17. A poster comprising:

a substrate substantially flat comprising a front side, a back side, a height, a width and a thickness where the height is greater than 11 inches, the width is greater than 8.5 inches, and the thickness is less than 1 inch and where said substrate is continuously flexible so that the substrate may be compactly stored;

an image portrayed on the front side of the substrate so that the image is visible from the front side and the image is portrayed within the height and within the width where the image substantially resembles at least one Christmas tree;

at least one light emitting source integrally and non-removably joined with the substrate where the light emitting source is visible from the front side and where the light emitting source is portrayed as at least one Christmas tree light, and wherein the light emitting source is a light emitting diode; and an electrical input affixed to the substrate where the electrical input is electrically coupled to at least one light emitting source and where the poster is substantially light enough to be placed upon a substantially vertical surface so that the image on the front side is visible.

18. The poster in claim 17, further including a power supply connected to the substrate where the power supply is electrically coupled to the electrical input in order to provide power to at least one the light emitting source.

19. The poster in claim 17, further including a battery affixed to the substrate where the battery is electrically coupled to the electrical input.

20. The poster in claim 17, further including an electrical plug affixed to the substrate where the electrical plug is electrically coupled to the electrical input.

* * * * *